United States Patent [19]

L'Hermite

[11] Patent Number: 4,956,576

[45] Date of Patent: Sep. 11, 1990

[54] DEVICE FOR COUPLING A FIRST DYNODE OF A PHOTOMULTIPLIER TO A LEAF-TYPE MULTIPLIER

[75] Inventor: Pierre L'Hermite, Brive, France

[73] Assignee: U.S. Philips Corp., New York, N.Y.

[21] Appl. No.: 361,525

[22] Filed: Jun. 5, 1989

[30] Foreign Application Priority Data

Jun. 10, 1988 [FR] France ..... 88 07778

[51] Int. Cl.[5] ..... H01J 43/06; H01J 43/02

[52] U.S. Cl. ..... 313/533; 313/532; 313/536

[58] Field of Search ..... 313/532, 533, 536, 541, 313/542, 544

[56] References Cited

U.S. PATENT DOCUMENTS 4,649,314 3/1987 Eschard ..... 313/103 R X

FOREIGN PATENT DOCUMENTS 2330541 1/1974 Fed. Rep. of Germany ..... 313/536

2544913 10/1984 France ..... 313/532

59-167946 9/1984 Japan .

*Primary Examiner*—Sandra L. O'Shea

*Attorney, Agent, or Firm*—William L. Botjer

[57] ABSTRACT

Photomultiplier tube (10) comprising a photocathode (20), a first cylindrical dynode (30), an electron multiplier device (40) of the "leaf" type, and a device (50) for coupling the first dynode (30) to the multiplier device (40). According to the invention, the said coupling device (50) consists, on the one hand, of a first electrode (51) composed of a cylindrical lateral plate (52) of axis parallel to that of the multiplier device and of an upper plate (53) pierced by an opening (54) for passage of the photoelectrons (21) towards the first dynode (30), and, on the other hand, of a second plane electrode (55) situated between the exit (32) of the first dynode (30) and the entrance (42) of the multiplier device (40).

1 Claim, 2 Drawing Sheets

DEVICE FOR COUPLING A FIRST DYNODE OF A PHOTOMULTIPLIER TO A LEAF-TYPE MULTIPLIER

BACKGROUND OF THE INVENTION

The present invention relates to a photomultiplier tube comprising a photocathode, a first dynode intended to receive the photoelectrons emitted by the photocathode, an electron multiplier device of the "leaf" type, and a device for coupling the first dynode to the multiplier device.

The invention is particularly advantageously applied in the field of photomultiplier tubes incorporating an electron multiplier device of the "leaf" type.

The general technical problem to be solved in the case of the photomultiplier tubes exhibiting a first dynode which, most frequently, is of large size in such a manner as to ensure a good collection of the photoelectrons, and a leaf-type multiplier device, is to couple the first dynode to the multiplier device in such a manner that the secondary electrons emitted by the first dynode can arrive, with low loss, at the leaf-type multiplier.

A solution to this general technical problem is given, for example, in the Japanese Pat. application No. JP-59-167946, which describes a photomultiplier tube according to the preamble, the first dynode of which is cylindrical, of generatrices orthogonal to an axis, the axis of the multiplier device being parallel to the said axis. In this known tube, the coupling between the first dynode and the leaf-type multiplier device is provided by placing between the first dynode and the multiplier device a set of three intermediate dynodes serving, to some extent, as deflectors of the electron beam in the direction of the multiplier.

Nevertheless, the known photomultiplier tube of the prior art exhibits the disadvantage of a relatively large longitudinal space requirement, due principally to the presence of the said intermediate dynodes which, moreover, make the assembly and the construction of such a tube more complex.

Further, the technical problem to be solved by the subject of the present invention is to propose a photomultiplier tube comprising a photocathode, a first cylindrical dynode of generatrices orthogonal to an axis and which is intended to receive the photoelectrons emitted by the photocathode, a multiplier device of the "leaf" type, and a device for coupling the first dynode to the multiplier device, the axis of the multiplier device being parallel to the said axis, with a view to providing a photomultiplier tube, the longitudinal space requirement of which would be reduced and the construction facilitated by a more advantageous arrangement of the leaf-type multiplier in relation to the first dynode.

SUMMARY OF THE INVENTION

The solution to the technical problem posed consists, according to the present invention, in that the said coupling device consists, on the one hand, of a first electrode composed of a cylindrical lateral plate of axis parallel to that of the multiplier device, surrounding the first dynode and the entrance of the multiplier device, and of an upper plate supported, facing the photocathode, on the lateral plate, and pierced by an opening for passage of the photoelectrons towards the first dynode, and, on the other hand, of a second plane electrode, parallel to the generatrices of the first dynode and situated between the exit of the first dynode and the entrance of the multiplier device, and in that the electrical potential of the first electrode is positive in relation to that of the photocathode and substantially equal to that of the first dynode, while the electrical potential of the second electrode is greater than that of the first electrode.

Thus, the intermediate dynodes being eliminated, it is possible to bring the multiplier device close to the first dynode, leading to a reduction of the space requirement of the tube and a greater facility of assembly. On the other hand, the first dynode - leaf-type multiplier coupling is effected, as will be seen further on in detail, by the combined set of the first and second electrodes.

An advantage of the invention, which will appear more clearly in the description of the drawings, resides in the fact that the upper plate of the first electrode participates not only in the coupling of the first dynode to the leaf-type multiplier device, but likewise serves for the focusing of the photoelectrons emanating from the photocathode on the first dynode.

BRIEF DESCRIPTION OF THE DRAWINGS

The description which will follow with reference to the accompanying drawings, which are given by way of non-limiting examples, will give a good understanding of that in which the invention consists and how it can be implemented.

DETAILED DESCRIPTION OF THE PREFERRED EMBODIMENTS

Figure 1:
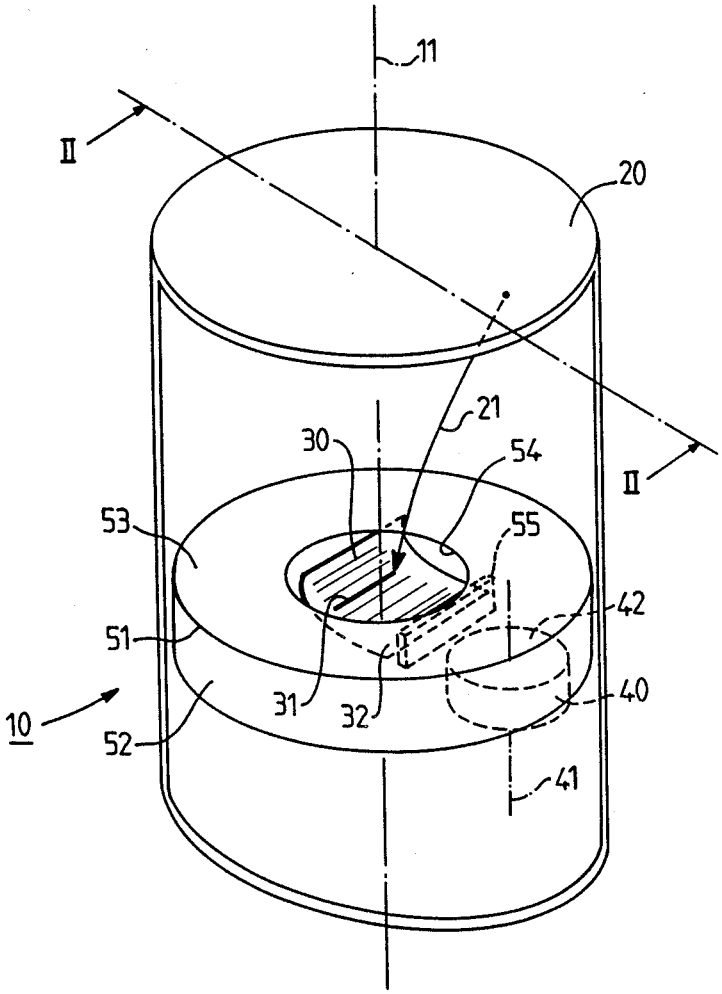
FIG. 1 is a perspective view of a photomultiplier tube comprising a coupling device according to the invention.
Figure 2:
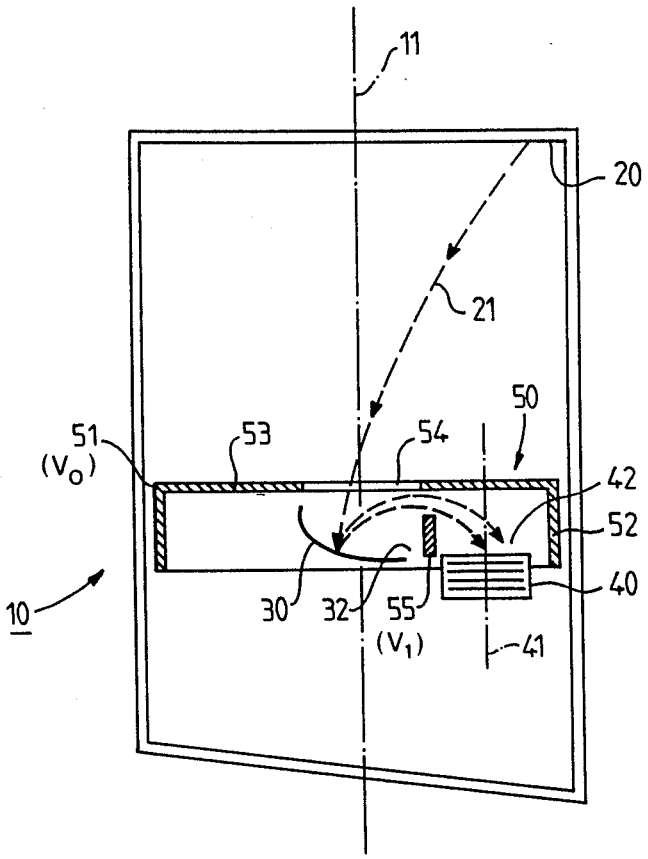
FIG. 2 cross-sectional view along the direction I—I of FIG. 1.

FIGS. 1 and 2 show, in perspective and in cross-section respectively, a photomultiplier tube 10 comprising a photocathode 20 which is, in general, deposited on a sealed window at the end of a cylindrical sleeve. Thus, the photomultiplier tube 10 possesses an axis 11 of symmetry which is likewise that of the photocathode 20. Under the effect of an incident light radiation, the photocathode 20 emits photoelectrons 21 which must be focused on a first dynode 30. As indicated by FIGS. 1 and 2, the first dynode 30 is of cylindrical shape, its generatrices 31 being orthogonal to the axis 11 of the tube. Moreover, the photomultiplier tube 11 comprises a multiplier device 40 known under the name of a leaf-type multiplier, an example of which is described in the French Pat. No. 2,549,288 which corresponds to U.S. Pat. No. 4,649,314. What is involved is essentially a device consisting of a stack of leaves, or metallic plates pierced by holes, the walls of which carry a layer of a secondary-emission material. The advantage of such a structure is to permit, with a reduced space requirement, the multiplication of incident electrons which are presented in the form of a broad beam.

As can be seen in FIGS. 1 and 2, the axis 41 of the multiplier device 40 is parallel to the axis 11 of the tube 10; this offers the possibility of bringing the multiplier close to the first dynode 30, and thus of reducing the lateral space requirement of the tube.

As shown by FIGS. 1 and 2, the device 50 for coupling the first dynode 30 to the multiplier device 40 comprises a first electrode 51 composed of a cylindrical lateral plate 52 of the same axis 11 as the tube, surrounding the first dynode 30 and the entrance 42 of the multiplier device 40, and of an upper plate 53 which is supported, facing the photocathode 20, on the lateral plate 52, and pierced by an opening 54 for passage of the photoelectrons 21 towards the first dynode 30. This first electrode 51 is brought to an electrical potential $V_0$, for example of 200V, which is positive in relation to that of the photocathode, which is at the potential 0V, and substantially equal to that of the first dynode 30. The coupling device 50 likewise comprises a second plane electrode 55, which is parallel to the generatrices 31 of the first dynode and situated between the exit 32 of the first dynode 30 and the entrance 42 of the multiplier device 40. The second electrode 55 is brought to an electrical potential $V_1$, for example of 300V, which is greater than that of the first electrode, and which may be substantially equal to the potential of the first electrode of the leaf-type multiplier device 40.

FIG. 2 shows how the coupling device 50 acts on the electron trajectories: the secondary electrons emitted by the first dynode 30 in consequence of the impact of the photoelectrons 21 are drawn from the exit 32 of the first dynode 30 towards the entrance 42 of the multiplier 40 by the second electrode 55 of potential $V_1$ greater than that of the first dynode 30. Then, after having cleared the second electrode, the secondary electrons are pushed back towards the multiplier device 40 by the lateral plate 52 and the upper plate 53 of the first electrode 51, which are at a lower electrical potential $V_o$.

It appears in FIGS. 1 and 2 that the upper plate 53 simultaneously provides two distinct functions: on the one hand, the first dynode - multiplier coupling, and, on the other hand, the focusing of the photoelectrons on the first dynode.

Although in FIGS. 1 and 2 the axis of the tube has been taken parallel to the axis of the multiplier device, this does not constitute an essential feature of the invention.

I claim:

1. Photomultiplier tube (10) comprising a photocathode (20), a first cylindrical dynode (30) of generatrices (31) orthogonal to an axis (11) and which is intended to receive the photoelectrons (21) emitted by the photocathode (20), an electron multiplier device (40) of the "leaf" type, and a device (50) for coupling the first dynode (30) to the multiplier device (40), the axis (41) of the multiplier device (40) being parallel to the said axis (11), characterized in that the said coupling device (50) consists, of a first electrode (51) composed of a cylindrical lateral plate (52) of axis parallel to that of the multiplier device, surrounding the first dynode (30) and the entrance (42) of the multiplier device (40), and of an upper plate (53) which is supported, facing the photocathode (20), on the lateral plate (52), and pierced by an opening (54) for passage of the photoelectrons (21) towards the first dynode (30) and, a second plane electrode (55), parallel to the generatrices (31) of the first dynode and situated between the exit (32) of the first dynode (30) and the entrance (42) of the multiplier device (40), and in that the electrical potential $(V_o)$ of the first electrode (51) is positive in relation to that of the photocathode (20) and substantially equal to that of the first dynode (30), while the electrical potential $(V_1)$ of the second electrode (55) is greater than that $(V_o)$ of the first electrode.

* * * * *